United States Patent [19]

Kawasaki et al.

[11] Patent Number: 4,556,994

[45] Date of Patent: Dec. 10, 1985

[54] FULLFACE-TYPE HELMET

[75] Inventors: Kazuhiro Kawasaki; Akio Muranaka, both of Saitama, Japan

[73] Assignee: Honda Giken Kogyo Kabushiki Kaisha, Tokyo, Japan

[21] Appl. No.: 571,504

[22] Filed: Jan. 17, 1984

[30] Foreign Application Priority Data

Jan. 20, 1983 [JP] Japan ..... 58-6587
Jan. 20, 1983 [JP] Japan ..... 58-7834

[51] Int. Cl.[4] ..... A61F 9/04
[52] U.S. Cl. ..... 2/424
[58] Field of Search ..... 2/424, 425, 6, 1, 2, 2/2.1 A, 5, 411, 412, 413, 414, 415, 416, 417, 418, 419, 420, 421, 422, 423

[56] References Cited

U.S. PATENT DOCUMENTS 2,388,674 11/1945 Browne ..... 2/2.1 R
3,362,403 1/1968 Fleming et al. ..... 2/6
3,797,040 3/1974 Caldwell ..... 2/425
4,083,065 4/1978 Warncke ..... 2/424
4,305,160 12/1981 Sundahl ..... 2/424
4,315,335 2/1982 Kennedy, Jr. et al. ..... 2/424

FOREIGN PATENT DOCUMENTS 2282767 of 1976 France ..... 2/425
2326156 4/1977 France ..... 2/353
634348 2/1962 Italy ..... 2/6
1576647 10/1980 United Kingdom ..... 2/424

*Primary Examiner*—Louis K. Rimrodt
*Assistant Examiner*—Joseph S. Machuga
*Attorney, Agent, or Firm*—Irving M. Weiner; Joseph P. Carrier; John J. Cantarella

[57] ABSTRACT

A helmet comprising a shell having a viewing window defined in a front portion thereof and a mouth opening defined therein below the window, a windshield detachably mounted on the shell for covering the window, and a mouth cap detachably mounted on the shell for covering the mouth opening. The face shield is movable back and forth with respect to the shell.

9 Claims, 17 Drawing Figures

FULLFACE-TYPE HELMET

BACKGROUND OF THE INVENTION

1. Field of the invention

The present invention relates to a full-face type helmet having a windshield.

2. Description of the Prior Art

Safety requires that the driver of a motorcycle or a motor-driven tricycle wear a protective helmet. One type of such a protective helmet is known as a jet-type helmet comprising a shell having a fully open front face with a face shield detachably mounted on the shell in front of the front face. Since the jet-type helmet with the face shield removed allows wind to hit the driver's face while the driver is driving the motorcycle, the jet-type helmet is suitable for use during summer and particularly popular among motorcyclists in scrambles.

Another popular protective helmet is known as a full-face type helmet comprising a shell having a viewing window defined in a front face thereof and a front lower portion disposed below the viewing window in covering relation to the jaws of the wearer. The full-face type helmet also has a light-transmitting face shield mounted on the shell in covering relation to the window for preventing wind from hitting the wearer's face while the wearer is driving a motorcycle.

Since the front face of the full-face type helmet is not fully open, the helmet is suitable for use in the winter season and is generally used in road racing. With the conventional full-face type helmet, a jaws covering portion thereof is closed and the face shield is angularly movably mounted on the shell only for either opening or closing the viewing window in the front face of the helmet. Therefore, no wind will directly hit the jaws of the helmet wearer or driver while driving the motorcycle, and hence the driver's exhalation tends to become stagnant in the helmet with no effective ventilation therein. When the viewing window is closed by the face-shield, in particular, the inner surface of the face shield is likely to be easily clouded and the wearer's voice is blocked by the helmet and becomes too weak to allow conversations with other drivers.

The present invention has been made to effectively eliminate the difficulties with the prior full-face type helmet.

SUMMARY OF THE INVENTION

According to the present invention, there is provided a full-face type helmet comprising a shell, a viewing window defined in a front portion of the shell, a light-transmitting face shield detachably mounted on the shell for covering the window, a mouth opening defined in the shell below the window, and a mouth cap detachably mounted on the shell for covering the mouth opening. The face-shield is mounted on the shell by a face shield frame angularly movably mounted on the shell, and is mounted on the face shield frame so as to be movable back and forth with respect to the latter.

Accordingly, it is an object of the present invention to provide a full-face type helmet capable of easily ventilating the interior of the helmet while covering a viewing window with a face shield easily removing a clouded state from the inner surface of the face shield, and allowing the voice of the wearer to be heard outside the helmet.

The above and other objects, features and advantages of the present invention will become more apparent from the following description when taken in conjunction with the accompanying drawings in which preferred embodiments of the present invention are shown by way of illustrative example.

Figure 7A:
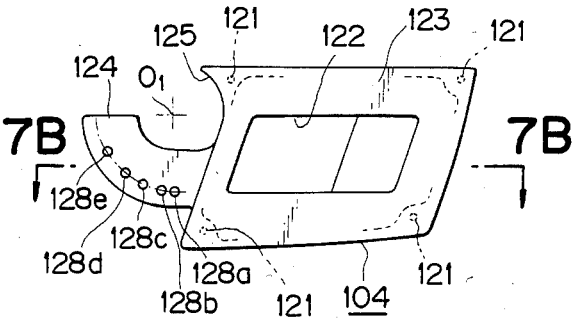
FIG. 7A is a front elevational view of a face shield base.

FIB. 7B is a cross-sectional view taken along line 7B—7B of FIG. 7A.

Figure 8A:
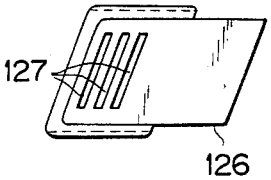
Figure 8B:
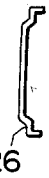

FIGS. 8A and 8B are front elevational and cross-sectional views of an ear cover.

Figure 9A:
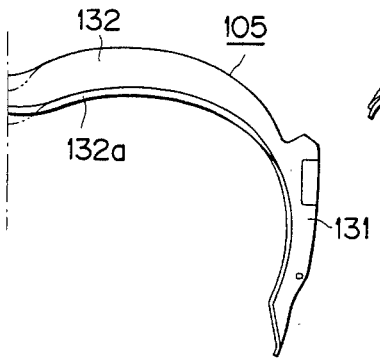
Figure 9B:
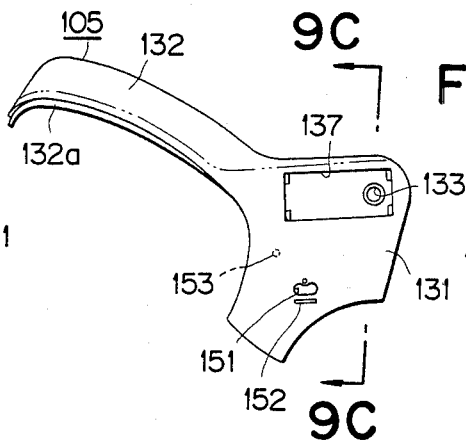

FIGS. 9A and 9B are front and side elevational, respectively, views of half of a face shield frame.

Figure 9C:
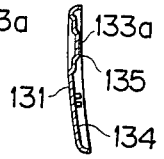

FIG. 9C is a cross-sectional view taken along line 9C—9C of FIG. 9B.

Figure 10A:
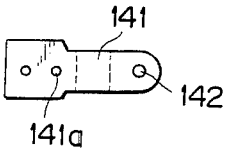
Figure 10B:
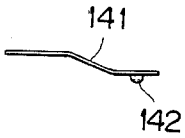

FIGS. 10A and 10B are front and side elevational views, respectively, of a spring member.

Figure 11A:
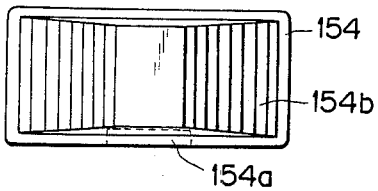
Figure 11B:
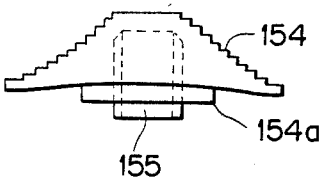

FIGS. 11A and 11B are front elevational and bottom views, respectively, of a face shield adjustment knob.

DETAILED DESCRIPTION OF THE PREFERRED EMBODIMENTS

Figure 1:
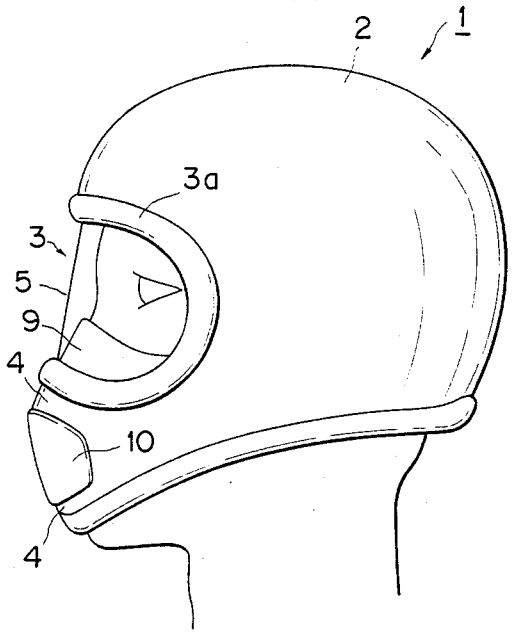
FIG. 1 is a side elevational view of a full-face type helmet according to a first embodiment of the present invention.
Figure 3:
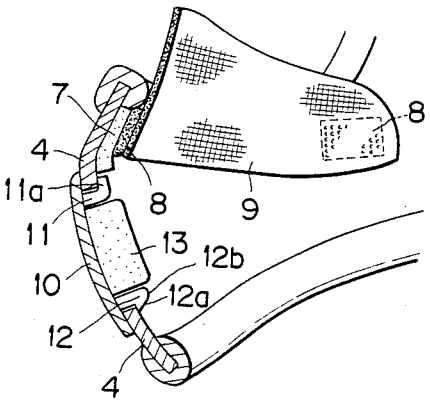
FIG. 3 is a cross-sectional view taken along line 3—3 of FIG. 2.
Figure 2:
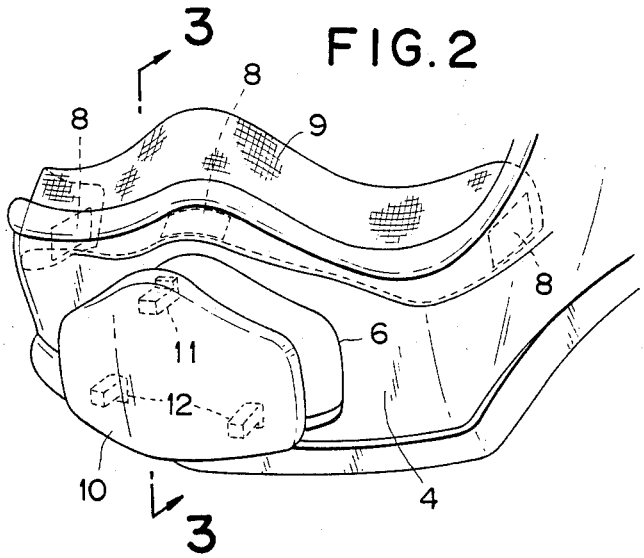
FIG. 2 is an exploded perspective view of a portion of the helment shown in FIG. 1.

As shown in FIGS. 1 through 3, a full-face type helmet (hereinafter referred to simply as a "helmet") 1 according to a first embodiment of the present invention comprises a shell 2 having a viewing window 3 defined centrally in a front face thereof and a mouth cap 10 mounted on a front lower portion 4 of the shell 2. A face shield 5 molded of transparent synthetic resin is removably mounted by a face shield frame 3*a* on the shell 2 in covering relation to the window 3. The front lower portion 4 of the shell 2 serves as a cover for the jaws of a wearer of the helmet 1.

As illustrated in FIG. 2, the jaws cover 4 has a central mouth opening 6 defined at a position substantially corresponding to the mouth of the helmet wearer. The mouth cap 10 is detachably disposed to entirely cover the opening 6 to open and close the opening 6. The mouth cap 10 has an upper locking finger 11 and a pair of lower locking fingers 12 projecting from an inner wall surface thereof, the locking fingers 11, 12 having hook portions 11*a*, 12*a*, respectively. When the mouth cap 10 is mounted on the jaws cover 4 over the opening 6, the hook portions 11*a*, 12*a* engage upper and lower inner edges of the opening 6 to fix the mouth cap 10 to the jaws cover 4 (see FIG. 3). For mounting the mouth cap 10, the upper locking finger 11 is first brought into engagement with the upper inner edge of the opening 6, and then the lower locking fingers 12 are inserted into engagement with the lower inner edge of the opening 6. To facilitate the attachment of the mouth cap 10, the locking fingers 12 have slanted surfaces 12*b* for easy insertion into the opening 6. A cushion material 13 of high air permeability and moisture absorption capability is attached centrally to the inner wall surface of the mouth cap 10.

As shown in FIG. 3, a nose cover 9 made of sponge or fabric is removably attached by Velcro fasteners 8 to an upper inner wall of the jaws cover 4 through a cushion material 13. The nose cover 9 is positioned in intimate contact with a face portion of the wearer beween the eyes and the nostrils to define an upper space in the helmet. The Velcro fasteners 8 are provided three in number and attached to central, left-hand and right-hand sides of a front lower portion of the nose cover 9.

When the helmet 1 of the foregoing construction is to be used in winter, the face shield 5 is mounted on the shell 2 over the window 3 and the nose cover 9 is mounted on the upper inner wall surface of the jaws cover 4. Since the nose cover 9 separates a lower space in the helmet in which the jaws are positioned from an upper space therein which is defined by the face shield 5, little or no exhalation of the wearer finds its way into the upper space, thus effectively preventing the windshield 5 from being clouded.

When it is desired to use the helmet 1 without the mouth cap 10, the tip ends of the lower locking fingers 12 are pushed upwardly and then outwardly to disengage the hook portions 12*a* from the lower inner edge of the opening 6. After the mouth cap 10 has been detached, there is nothing left in the opening 6 which blocks the wearer's voice and the wearer can converse with others through the opening 6. This arrangement is especially advantageous when drivers are driving together while communicating with each other through microphones.

With only the mouth cap 10 removed, any wind entering into the shell 2 through the opening 6 is blocked by the nose cover 9 and hence are prevented from hitting the wearer's eyes.

For use of the helmet 1 during the summer season, the face shield 5 can be detached from the window 3, and the mouth cap 10 and the nose cover 9 can also be removed. Accordingly, the wearer can enjoy a comfortable drive while receiving wind all over the face as with the jet-type helmet. When it is preferable to protect the eyes from wind in summer, the face shield 5 should be mounted in the window 3 and the nose cover 9 should be attached to the upper inner wall surface of the jaws cover 4. The nose cover 9 thus installed prevents any wind coming in through the opening 6 from directly impinging on the eyes.

With the above arrangement according to the first embodiment, the front lower portion of the full-face type helmet, which covers the wearer's jaws, has an opening, and a mouth cap is detachably mounted on the shell in covering relation to the opening. Therefore, it is rendered possible for the wearer to introduce outer air into the helmet through the opening to effectively prevent the wearer's exhalation from being trapped in the helmet. With the mouth cap detached, the wearer can easily talk to others through the opening. Stated otherwise, when the mouth cap is detached from the helmet shell, the helmet can be used in the same manner as that of the known jet-type helmet. When the mouth cap is attached in position, the full-face type helmet can perform its intended original function.

Since the nose cover 9 is disposed in the helmet shell to substantially separate the upper space in the shell from the lower space therein into which the wearer's exhalations are discharged, the inner surface of the windshield is reliably prevented from becoming clouded.

Figure 4:
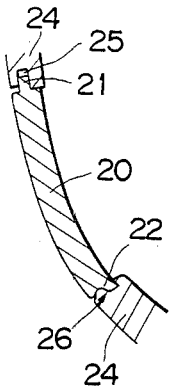
FIG. 4 is a fragmentary cross-sectional view of a modification of the full-face type helment of the first embodiment.

FIG. 4 shows a modified mouth cap 20 and its attachment construction. Any non-illustrated helmet portion remains the same as that of the helmet shown in FIG. 1. The mouth cap 20 has a ridge 21 and a groove 22 which engage a groove 25 and a ridge 26, repsectively, formed along the edge of a jaws cover 24. The mouth cap 20 is attached to the helmet shell through interfitting engagement of these ridges and grooves. The modification is as advantageous as the helment of the first embodiment of the present invention. The configuration of the mouth cap and its attachment structure may be selected as desired.

Figure 5:
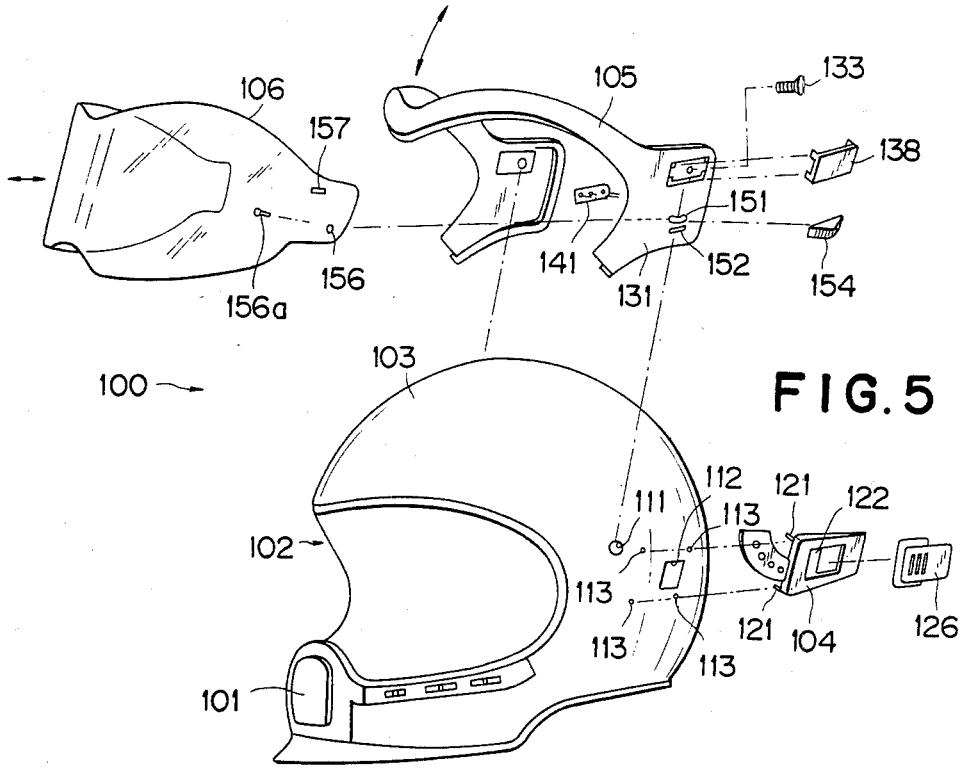
FIG. 5 is an exploded perspective view of a full-face type helmet according to a second embodiment of the present invention.
Figure 6:
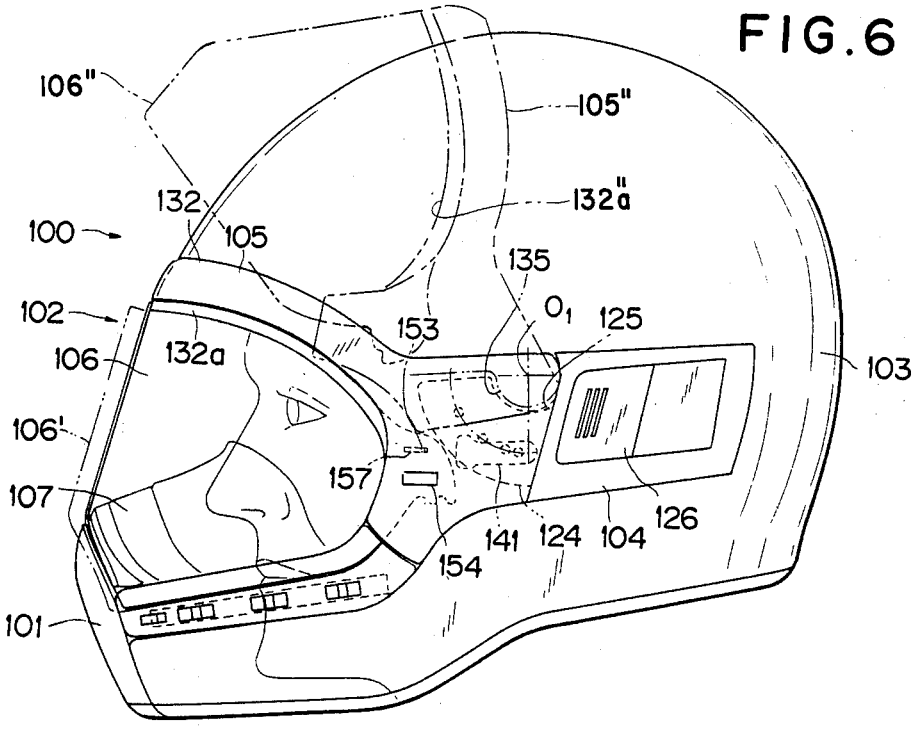
FIG. 6 is a side elevational view of the helmet shown in FIG. 5 as it is worn by a wearer.

FIGS. 5 and 6 illustrate a full-face type helmet according to a second embodiment of the present invention. The full-face type helmet, generally indicated at 100, comprises a shell 103 having a mouth cap 101 detachably mounted on a front lower portion thereof and a window 102 defined in a front central portion thereof, face shield base 104 attached respectively to opposite sides of the shell, and a face shield frame 105 having a face shield 106 for covering the window 102 and atached to the shell 103. The mouth cap 101 is of the same construction as that of the mouth cap according to the first embodiment. A nose cover 107 which is identical to that of the first embodiment is disposed in the shell 103.

The sides of the shell 103 have recesses 112, respectively, at positions corrsponding to the ears of a helmet wearer, there being four apertures 113 defined in the shell 103 around each of the recesses 112 for attaching the face shield base 104. A bolt hole 111 is defined in each side of the shell 103 at a position forward of the recess and apertures for attaching the face shield frame 105 angularly movably to the shell 103.

Figure 7B:
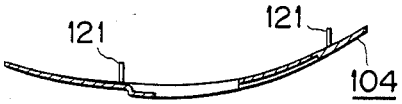

As shown in FIGS. 7A and 7B, each face shield windshield base 104 comprises four pins 121 projecting from its inner surface for insertion into the respective apertures 113, a body 123 having an opening 122 which wil be held in registry with the recess 112 when attached to the shell 103, and an arcuate guide 124 extending forward and upwardly from a front edge of the body 123. The front edge of the body 123 and the upper edge of the guide 124 jointly define an arcuate guide edge 125 having a center $O_1$ of curvature held in conformity with the center of the bolt hole 111. The guide edge 125 serves to allow stable angular movement of the face shield frame 105. The guide 124 has five apertures 128*a* through 128*e* which are equidistant from the center $O_1$ for holding the face shield frame 105 selectively at prescribed angular positions.

As shown in FIGS. 8A and 8B, an ear cover 126 is horizontally slidably disposed in the opening 122 in the face shield base 104. The ear cover 126 can be slidably moved horizontally back and forth by engaging a plurality of ridges 127 on the ear cover 126.

As illustrated in FIGS. 9A, 9B, and 9C, the windshield frame 105 comprises a pair of base portions 131, 131 to be disposed on the respective sides of the shell 103, and an intermediate portion 132 interconnecting the base portions 131, 131. The frame 105 has an inner edge 132*a* shaped in conformity with upper and lateral side edges of the window 102. Each base portion 131 has an upper bolt hole 133*a*. A bolt 133 (FIG. 5) extends through the bolt hole 133*a* threadedly into the bolt hole 111 defined in the shell 103. Thus, the face shield frame 105 is mounted on the shell 103 for angular movement about the bolts 133, that is, the center $O_1$ shown in FIG. 7A. The base portion 131 has a rectangular recess 137 around the bolt hole 133*a* and in which a bolt cover 138 shown in FIG. 5 is fitted to give the base portion 131 a pleasing appearance. As shown in FIG. 9C, a substantially semicircular guide projection 135 is formed on a reverse side 134 of the base portion 131 around the bolt hole 133*a*. The guide projection 135 is of a size to engage the guide edge 125 shown in FIG. 7A. The base portion 131 also has a lower guide hole 151 extending horizontally and a slot 152 disposed directly below the guide hole 151, there being a pin 153 projecting from the reverse side 134 of the base portion 134 and positioned obliquely upwardly of the guide hole 151. As illustrated in FIG. 5, each side of the face shield 106 has a circular aperture 156 and a horizontal slot 157 which positionally correspond to the pin 153 and the guide hole 151, respectively. For attaching the face shield 106 to the frame 105, the slot157 in the face shield 106 is fitted over the pin 153, and a pin 156*a* is inserted, from inside, through the aperture 156 and the guide hole 151. Then, a knob 154 (FIGS. 11A and 11B) is fitted over the tip of the pin 156*a*, the knob 154 having a leg 155 to be fitted over the pin 156*a* and a guide projection 154*a* to be inserted in the slot 152 in the face shield frame 105. Therefore, the windshield 106 is rendered horizontally movable with respect to the face shield frame 105 by moving the knob 154 horizontally back and forth. Then the face shield frame 105 is swung around the bolt 133, the face shield 106 is also swung with the frame 105. The base portion 131 of the frame 105 has a rear edge aligned with the front edge of the body 123 of the face shield base 104.

Referring back to FIG. 5, a bent leaf spring 141 is attached by a non-illustrated bolt to the inner surface of each of the base portions 131 of the face shield frame 105. The leaf spring 141 has, as shown in FIGS. 10A and 10B, attachment holes 141*a* and a semispherical projection 142 engageable in one, at a time, of the apertures 128*a* through 128*e* in the guide 124 of the face shield base 104. For assembly, the face shield base 104 is attached to the shell 103 before the face shield frame 105 is installed on the shell 103. Thereafter, the face shield frame 105 with the face shield 106 and the leaf springs 141 assembled is mounted on the shell 103.

The helmet 100 as assembled is illustated in FIG. 6. The face shield frame 105 is mounted on the shell 103 with the semicircular guide projections 135 of the face shield frame 105 being held in abutment against the guide edges 125, the rear edges of the frame 105 in abutment against the front edges of the face shield base bodies 123, and the projections 142 on the leaf springs 141 engaging in the apertures 128*a*. The face shield 106 is shown in FIG. 6 as being positioned by the knob 154 in its front position. When the face shield 106 is thus moved to the front position by the knob 154, the face shield 106 is moved to a position shown by the broken line 106′ to provide a gap between the face shield 106 and the frame 105 for venting an upper space above the nose cover in the helmet to atmosphere. When it is desired to move the face shield 106 to a position shown by the broken line 106″, for example, the windshield 106 or the frame 105 is appropriately moved until the face shield 106 is held in the position 106″ by engagement of the leaf springprojection 142 in the aperture 128*e*. The frame 105 and the inner edge 132*a* thereof in such a state are indicated by the broken lines 105″ and 132*a*″, respectively. The engagement of the guide projection 135 with the guide edge 125 permits the face shield frame 105 to turn smoothly. In the solid-line position of the face shield 106 shown in FIG. 6, the projection 142 engages in the aperture 128*a*. However, the face shield 106 can be held as desired in one of the stepped angular positions by engagement between the projection 142 and a selected one of the apertures 128*a* through 128*e*.

With the arrangement of the second embodiment, the face shield frame 105 and the face shield 106 can be held in one of the stepped angular positions by engagement between the projection 142 and a selected one of the apertures 128*a* through 128*e*. Accordingly, the wearer can introduce a desired amount of outer air through the window 102 into the helmet 100 dependent on the driving conditions. Since the face shield is movable horizontally back and forth with respect to the face shield frame, it is possible to introduce outer air into the helmet while substantially covering the window. This effectively and easily removes any unwanted clouded state from the inner surface of the face shield or effects ventilation in the helmet. The shell 103 has the recesses 112, and the face shield bases 104 have the openings 122 which are closed by the ear covers 126 slidably disposed therein. The ear covers 126 can be manipulated to let the wearer hear external sounds as desired.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

The invention claimed is:

1. A full-face type helmet having a shell which opens downwardly, a viewing window in the front portion of said shell, and a light-permeable face shield detachably mounted on said shell for covering said window, the improvement comprising:

a mouth opening defined in said shell below said window;

a mouth cap detachably mounted on said shell for covering said mouth opening;

a nose cover detachably mounted in said shell for intimate contact with a face portion of a wearer between the eyes and nostrils to define an upper space in said helmet; and said nose cover being mounted to said shell between said viewing window and said mouth opening.

2. A full-face type helmet according to claim 1, wherein said shell has hearing openings defined in sides thereof, including ear covers mounted on said shell for closing and opening said hearing openings.

3. A full-face type helmet according to claim 2, including a face shield frame angularly movably mounted on said shell, said face shield being mounted by said face shield frame on said shell.

4. A full-face type helmet according to claim 3, wherein said face shield is mounted on said face shield frame for back-and-forth movement with respect thereto.

5. A full-face type helmet according to claim 3, including holder means for holding said face shield frame at a prescribed angular position.

6. A full-face type helmet according to claim 5, wherein:

said face shield frame further comprises a face shield base fixedly mounted on said shell; and said face shield frame is angularly movably mounted on said face shield base.

7. A full-face type helmet according to claim 6, wherein:

said hearing openings of said shell are located at said face shield base; and said ear covers are slidably mounted on said face shield base for closing and opening said hearing openings.

8. A full-face type helmet according to claim 2, wherein:

said ear covers are slidably mounted on said shell.

9. A full-face type helmet according to claim 1, wherein:

said nose cover is detachably mounted to said shell by Velcro fastener means.

* * * * *